US011207905B2

(12) United States Patent
Matsuo et al.

(10) Patent No.: US 11,207,905 B2
(45) Date of Patent: Dec. 28, 2021

(54) PRINTING APPARATUS

(71) Applicant: CANON KABUSHIKI KAISHA, Tokyo (JP)

(72) Inventors: Kazuki Matsuo, Kawasaki (JP); Seiji Ogasawara, Machida (JP); Takaaki Ishida, Kawasaki (JP); Shuichi Tokuda, Kawasaki (JP); Masakazu Tsukuda, Yokohama (JP); Masaaki Matsuura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/269,076

(22) Filed: Feb. 6, 2019

(65) Prior Publication Data

US 2019/0243300 A1 Aug. 8, 2019

(30) Foreign Application Priority Data

Feb. 8, 2018 (JP) ..... JP2018-021194

(51) Int. Cl.
*B41J 29/13* (2006.01)
*B41J 11/00* (2006.01)

(52) U.S. Cl.
CPC ..... *B41J 29/13* (2013.01); *B41J 11/006* (2013.01)

(58) Field of Classification Search
CPC ..... B41J 29/13; B41J 11/006; G03G 21/1638; G03G 21/1633
See application file for complete search history.

(56) References Cited

U.S. PATENT DOCUMENTS 6,398,357 B1 * 6/2002 Holloway ..... B41J 2/0057 347/100
2005/0062793 A1 3/2005 Takagi et al.
2005/0220488 A1 * 10/2005 Fujita ..... G03G 15/70 399/124
2005/0254849 A1 * 11/2005 Honma ..... G03G 15/70 399/80
2017/0248902 A1 * 8/2017 Yamamoto ..... G03G 21/1633

FOREIGN PATENT DOCUMENTS

JP 2005-018011 A 1/2005
JP 2005-096187 A 4/2005
JP 2010-149308 A 7/2010

OTHER PUBLICATIONS

Sep. 21, 2021 Japanese Official Action in Japanese Patent Appln. No. 2018-021194.

* cited by examiner

*Primary Examiner* — Julian D Huffman
(74) *Attorney, Agent, or Firm* — Venable LLP

(57) ABSTRACT

Provided is a printing apparatus that allows the user to easily perceive that the cover is unlocked. In the printing apparatus that includes: a cover unit configured to expose the conveying path, along which the printing medium is conveyed, to the outside when the cover unit is opened and that shields the conveying path when the cover unit is closed; and a locking configured to lock the cover unit to keep it closed, and that performs printing on the printing medium being conveyed along the conveying path, the cover unit is urged by an urging unit in the opening direction. In addition, when the locking unit unlocks the cover unit the cover unit is opened by a predetermined degree by the urging force of the urging unit.

20 Claims, 13 Drawing Sheets

PRINTING APPARATUS

BACKGROUND OF THE INVENTION

Field of the Invention

The present invention relates to printing apparatuses that perform printing on printing media being conveyed.

Description of the Related Art

According to the technique disclosed in Japanese Patent Laid-Open No. 2010-149308, when a printing medium being conveyed gets stuck in a printing apparatus, or what is called a jam occurs, the print head is protected, and then a cover for actions to resolve the jam (for jam resolving actions) is made openable. Specifically, in the technique disclosed in Japanese Patent Laid-Open No. 2010-149308, when the occurrence of a jam is detected, the cover for jam resolving actions that covers part of the conveying path at which the jam occurs is unlocked and made openable.

Unfortunately, in the technique disclosed in Japanese Patent Laid-Open No. 2010-149308, even though the cover is unlocked, processes such as presenting, for example, information on the unlocking to the user are not performed. Thus, it is difficult for the user to perceive which cover is unlocked at the time.

SUMMARY OF THE INVENTION

The present invention has been made in light of the above problem, and an object thereof is to provide a printing apparatus that allows the user to easily perceive which cover is unlocked.

In the first aspect of the present invention, there is provided a printing apparatus comprising:

a conveying unit configured to convey a printing medium along a conveying path;

a print unit configured to apply print material on a printing medium being conveyed by the conveying unit;

a cover unit that is capable of opening and closing such that the conveying path is exposed to an outside when the cover unit is opened and the cover unit shields the conveying path from the outside when the cover unit is closed;

an urging unit configured to urge the cover unit in an opening direction of the cover unit; and a locking unit configured to lock the cover unit to keep the cover unit closed, wherein when the locking unit unlocks the cover unit, the cover unit is opened by a predetermined degree by urging force of the urging unit.

The present invention makes it possible for the user to easily perceive which cover is unlocked.

Further features of the present invention will become apparent from the following description of exemplary embodiments with reference to the attached drawings.

DESCRIPTION OF THE EMBODIMENTS

Figure 1:
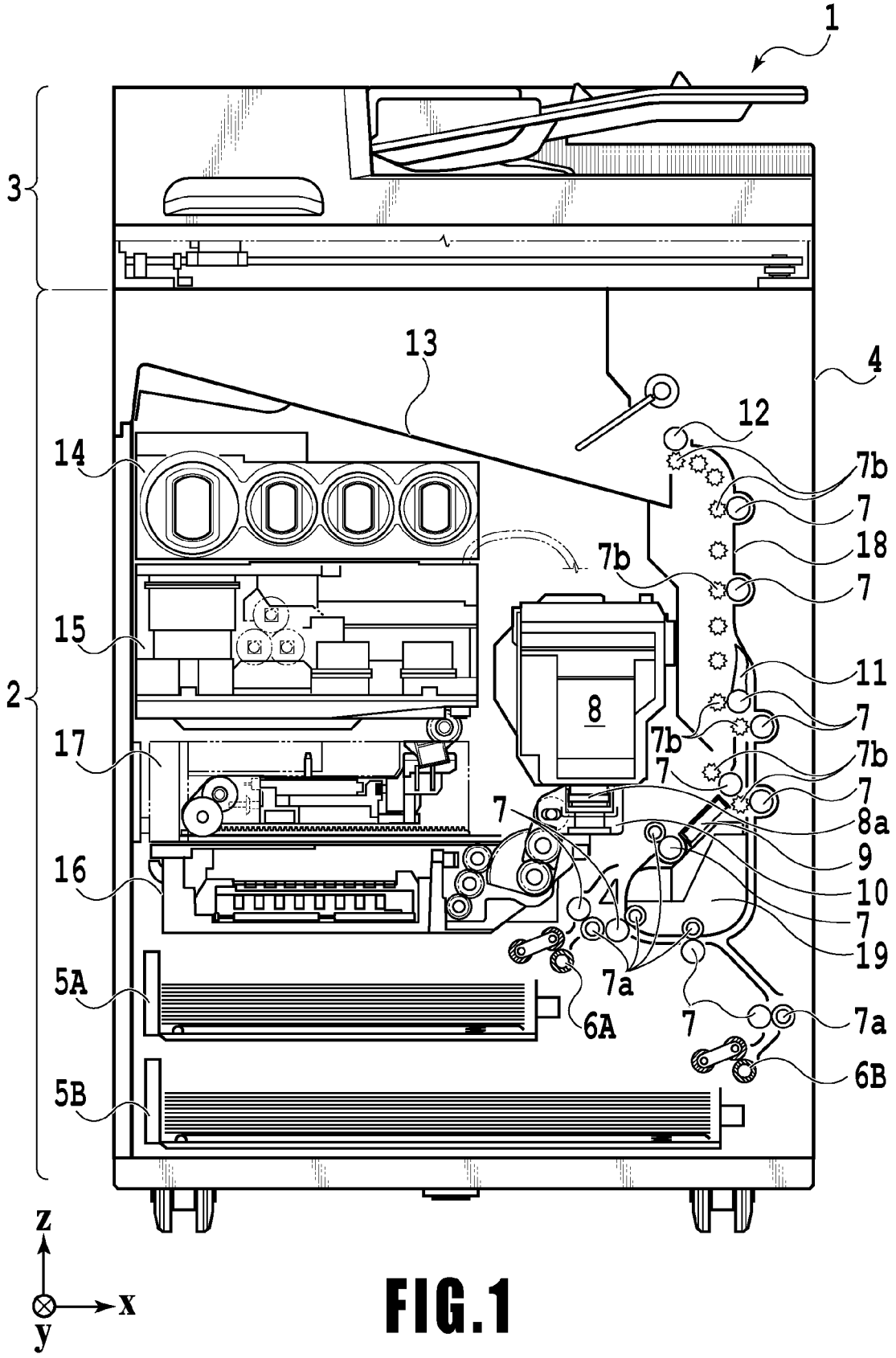
FIG. 1 is a view of a printing apparatus in a standby state.

FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to paper) is a direction in which ejection openings are arrayed in a print head 8 described later, and a z-direction is a vertical direction.

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed scanner (FBS) and is capable of scanning a document automatically fed by the ADF as well as scanning a document placed by a user on a document plate of the FBS. The present embodiment is directed to the multifunction printer comprising both the print unit 2 and the scanner unit 3, but the scanner unit 3 may be omitted. FIG. 1 shows the printing apparatus 1 in a standby state in which neither print operation nor scan operation is performed.

In the print unit 2, a first cassette 5A and a second cassette 5B for housing printing medium (cut sheets) S are detachably provided at the bottom of a casing 4 in the vertical direction. Relatively small printing medium of up to A4 size are stacked and housed in the first cassette 5A and relatively large printing medium of up to A3 size are stacked and housed in the second cassette 5B. A first feeding unit 6A for feeding housed printing medium one by one is provided near the first cassette 5A. Similarly, a second feeding unit 6B is provided near the second cassette 5B. In print operation, a print medium S is selectively fed from either one of the cassettes.

Conveying rollers 7, a discharging roller 12, pinch rollers 7*a*, spurs 7*b*, a guide 18, an inner guide 19, and a flapper 11 are conveying mechanisms for guiding a print medium S in a predetermined direction. The conveying rollers 7 are drive rollers located upstream and downstream of the print head 8 and driven by a conveying motor (not shown). The pinch rollers 7*a* are follower rollers that are turned while nipping a print medium S together with the conveying rollers 7. The discharging roller 12 is a drive roller located downstream of the conveying rollers 7 and driven by the conveying motor (not shown). The spurs 7*b* nip and convey a print medium S together with the conveying rollers 7 and discharging roller 12 located downstream of the print head 8.

The printing apparatus 1 has multiple motors for driving the above drive rollers, and each drive roller is connected to one of the motors. The relationship between the motors and the drive roller will be described later in detail.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 is a tray for stacking and housing printing medium S that were subjected to print operation and discharged by the discharging roller 12.

The print head 8 of the present embodiment is a full line type color inkjet print head. In the print head 8, a plurality of ejection openings configured to eject ink based on print data are arrayed in the y-direction in FIG. 1 so as to correspond to the width of a print medium S. That is, the print head is configured to eject inks of a plurality of colors. When the print head 8 is in a standby position, an ejection opening surface 8*a* of the print head 8 is oriented vertically downward and capped with a cap unit 10 as shown in FIG. 1. In print operation, the orientation of the print head 8 is changed by a print controller 202 described later such that the ejection opening surface 8*a* faces a platen 9. The platen 9 includes a flat plate extending in the y-direction and supports a print medium S being subjected to print operation by the print head 8 from the back side. The movement of the print head 8 from the standby position to a printing position will be described later in detail.

An ink tank unit 14 separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform maintenance operation for the print head 8. The maintenance operation will be described later in detail.

Figure 2:
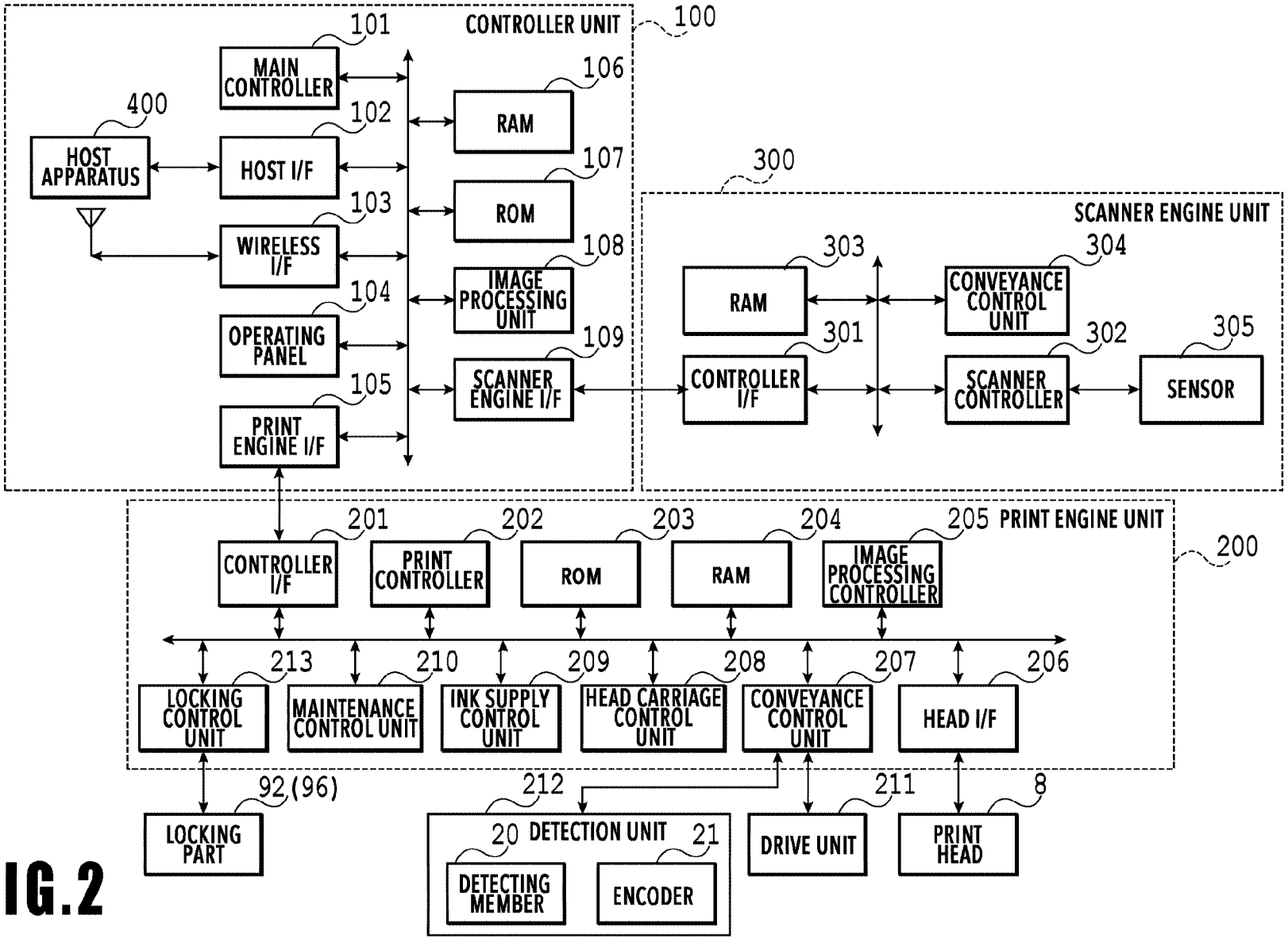
FIG. 2 is a diagram of a control configuration of the printing apparatus.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, when a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, when a scan command is input from the host apparatus 400, the main controller 101 transmits the command to the scanner unit 3 via a scanner engine I/F 109.

An operating panel 104 is a mechanism to allow a user to do input and output for the printing apparatus 1. A user can give an instruction to perform operation such as copying and scanning, set a print mode, and recognize information about the printing apparatus 1 via the operating panel 104.

In the print engine unit 200, the print controller 202 including a CPU controls various mechanisms of the print unit 2 using a RAM 204 as a work area in accordance with various parameters and programs stored in a ROM 203. When various commands and image data are received via a controller I/F 201, the print controller 202 temporarily stores them in the RAM 204. The print controller 202 allows an image processing controller 205 to convert the stored image data into print data such that the print head 8 can use it for print operation. After the generation of the print data, the print controller 202 allows the print head 8 to perform print operation based on the print data via a head I/F 206. At this time, the print controller 202 conveys a print medium S by driving the feeding units 6A and 6B, conveying rollers 7, discharging roller 12, and flapper 11 shown in FIG. 1 via a conveyance control unit 207. The print head 8 performs print operation in synchronization with the conveyance operation of the print medium S under instructions from the print controller 202, thereby performing printing.

The conveyance control unit 207, connected to the detection unit 212 for detecting the conveyance state of the printing medium S and the drive unit 211 for driving the drive rollers, controls the conveyance of the printing medium S using the drive unit 211, based on detection results obtained from the detection unit 212. The detection unit 212 has the detection members 20 for detecting the printing medium S and the encoders 21 for detecting the amount of rotation of the drive rollers.

Printing is performed in the course of the conveyance of the printing medium S by the conveyance control unit 207, by the print head 8 performing print operation under instructions from the print controller 202.

A head carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 when performing maintenance operation for the print head 8. The locking control unit 213, under instructions from the print controller 202, controls locking parts 92 and 96 (to be described later) to control opening and closing of a cover 90 (to be described later).

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller I/F 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

Figure 3:
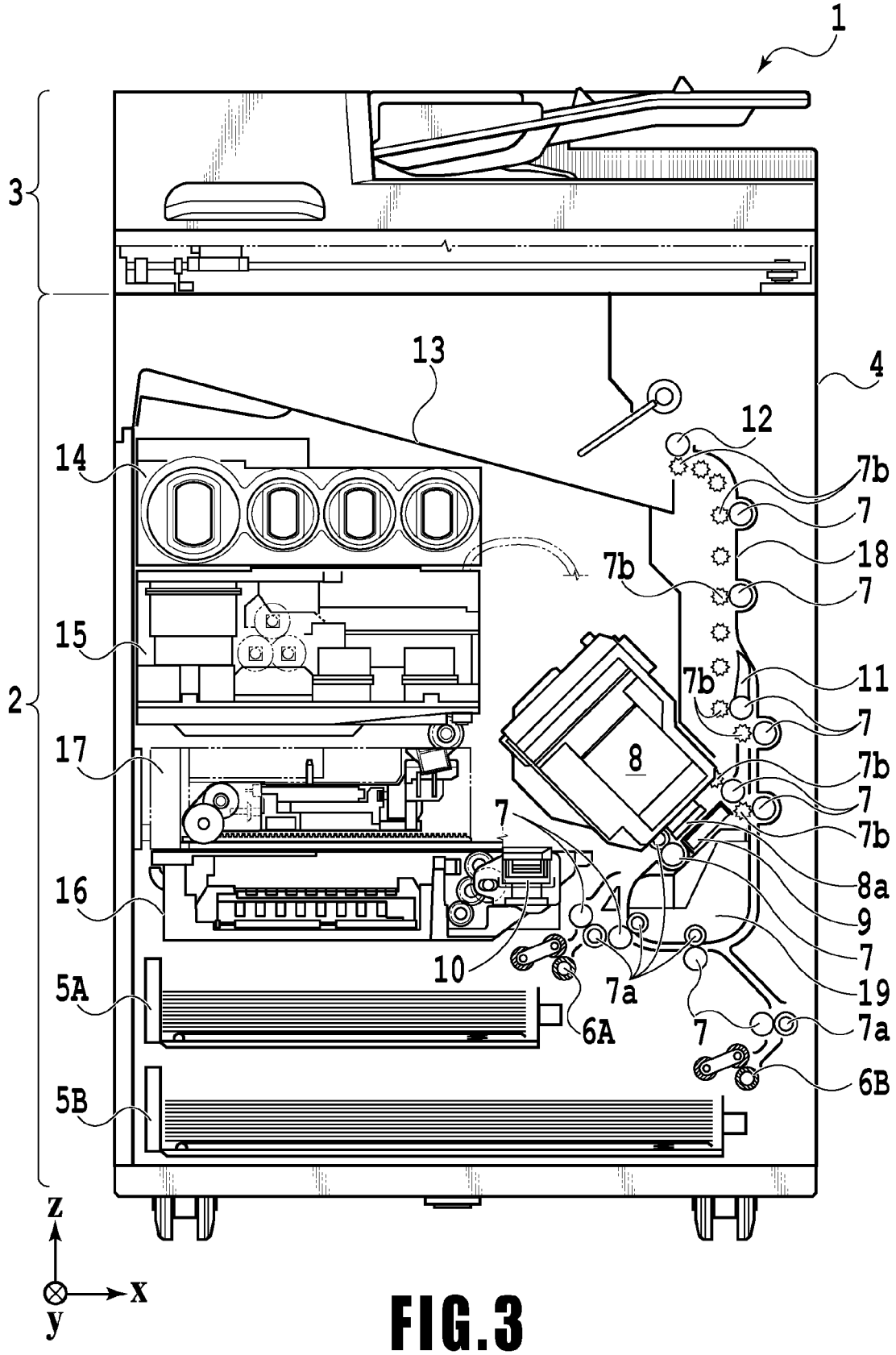
FIG. 3 is a view of the printing apparatus in a print state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45° with respect to the horizontal plane. The ejection opening surface 8*a* of the print head 8 in a printing position is also inclined about 45° with respect to the horizontal plane so as to keep a constant distance from the platen 9.

In the case of moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating the cap member 10*a* from the ejection opening surface 8*a* of the print head 8. The print controller 202 then uses the head carriage control unit 208 to turn the print head 8 45° while adjusting the vertical height of the print head 8 such that the ejection opening surface 8*a* faces the platen 9. After the completion of print operation, the print controller 202 reverses the above procedure to move the print head 8 from the printing position to the standby position.

Next, a conveying path of a print medium S in the print unit 2 will be described. When a print command is input, the print controller 202 first uses the maintenance control unit 210 and the head carriage control unit 208 to move the print head 8 to the printing position shown in FIG. 3. The print controller 202 then uses the conveyance control unit 207 to drive either the first feeding unit 6A or the second feeding unit 6B in accordance with the print command and feed a print medium S.

Figure 4C:
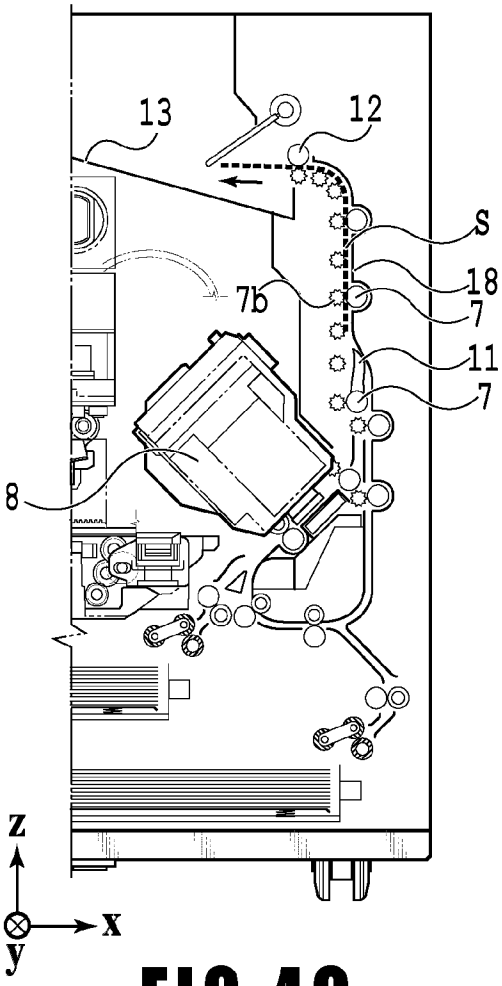
FIG. 4A, FIG. 4B, and FIG. 4C are views of a conveying path of a print medium fed from a first cassette.
Figure 4B:
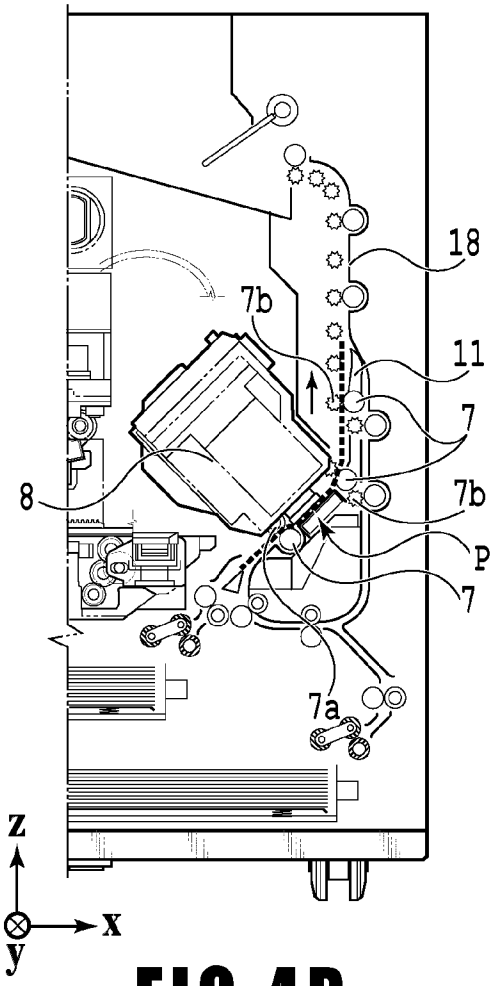
Figure 4A:
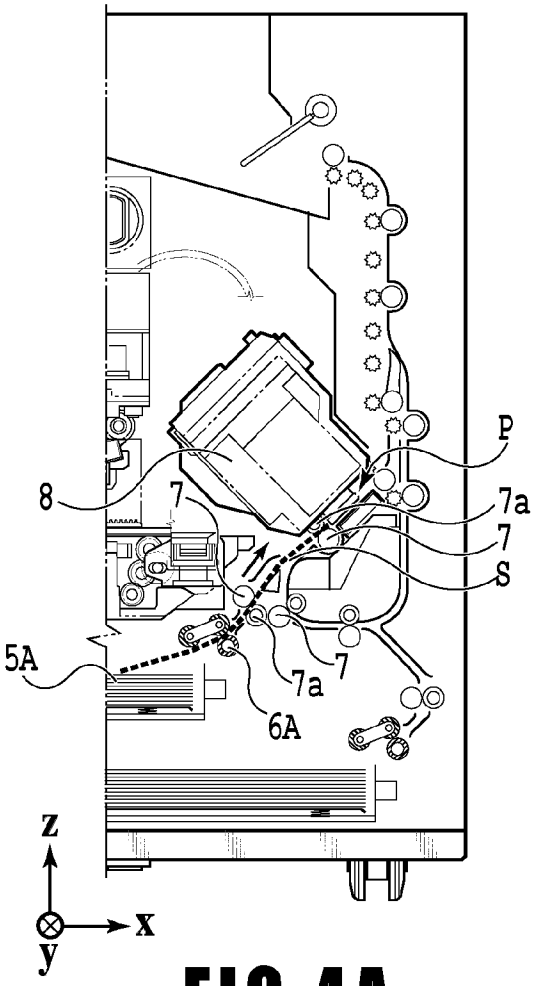

FIGS. 4A to 4C are diagrams showing a conveying path in the case of feeding an A4 size print medium S from the first cassette 5A. A print medium S at the top of a stack of printing medium in the first cassette 5A is separated from the rest of the stack by the first feeding unit 6A and conveyed toward a print area P between the platen 9 and the print head 8 while being nipped between the conveying rollers 7 and the pinch rollers 7*a*. FIG. 4A shows a conveying state where the front end of the print medium S is about to reach the print area P. The direction of movement of the print medium S is changed from the horizontal direction (x-direction) to a direction inclined about 45° with respect to the horizontal direction while being fed by the first feeding unit 6A to reach the print area P.

In the print area P, a plurality of ejection openings provided in the print head 8 eject ink toward the print medium S. In an area where ink is applied to the print medium S, the back side of the print medium S is supported by the platen 9 so as to keep a constant distance between the ejection opening surface 8*a* and the print medium S. After ink is applied to the print medium S, the conveying rollers 7 and the spurs 7*b* guide the print medium S such that the print medium S passes on the left of the flapper 11 with its tip inclined to the right and is conveyed along the guide 18 in the vertically upward direction of the printing apparatus 1. FIG. 4B shows a state where the front end of the print medium S has passed through the print area P and the print medium S is being conveyed vertically upward. The conveying rollers 7 and the spurs 7*b* change the direction of movement of the print medium S from the direction inclined about 45° with respect to the horizontal direction in the print area P to the vertically upward direction.

After being conveyed vertically upward, the print medium S is discharged into the discharging tray 13 by the discharging roller 12 and the spurs 7*b*. FIG. 4C shows a state where the front end of the print medium S has passed through the discharging roller 12 and the print medium S is being discharged into the discharging tray 13. The discharged print medium S is held in the discharging tray 13 with the side on which an image was printed by the print head 8 down.

Figure 5C:
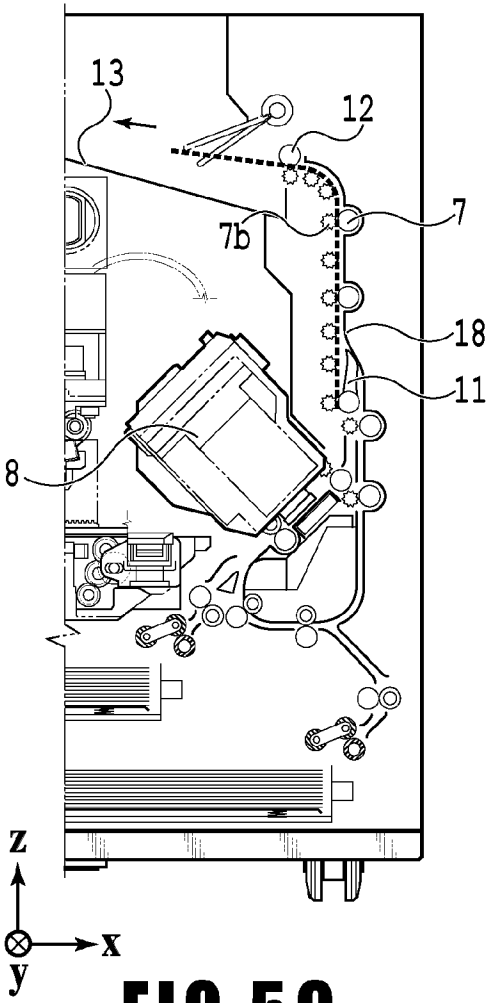
FIG. 5A, FIG. 5B, and FIG. 5C are views of a conveying path of a print medium fed from a second cassette.
Figure 5B:
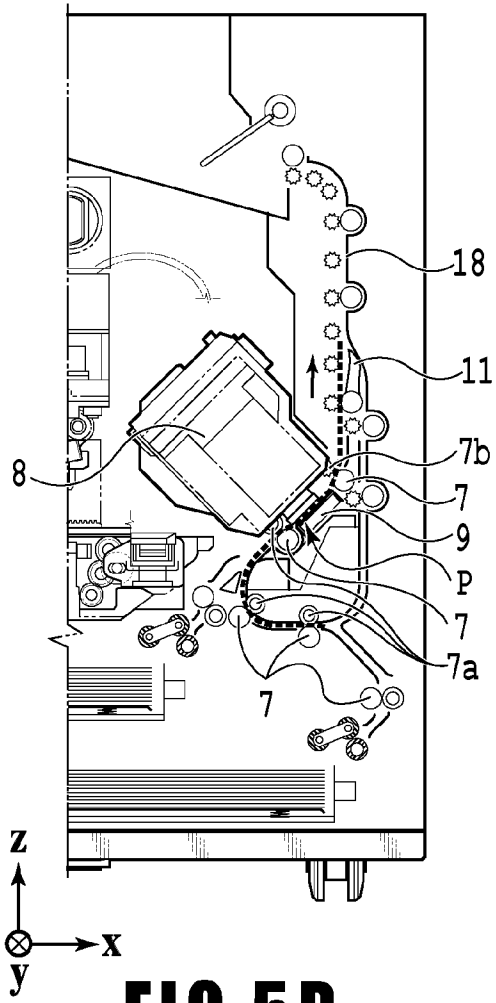
Figure 5A:
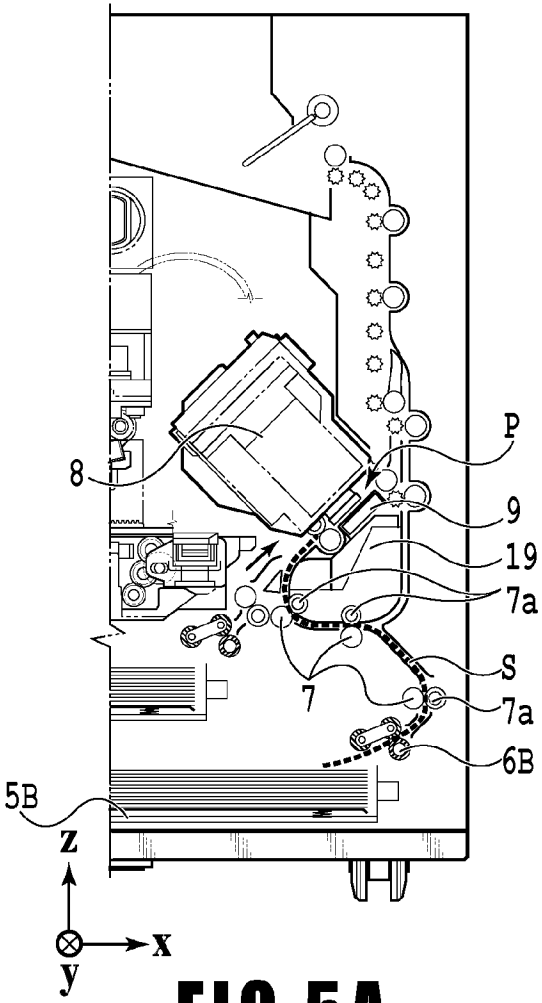

FIGS. 5A to 5C are diagrams showing a conveying path in the case of feeding an A3 size print medium S from the second cassette 5B. A print medium S at the top of a stack of printing medium in the second cassette 5B is separated from the rest of the stack by the second feeding unit 6B and conveyed toward the print area P between the platen 9 and the print head 8 while being nipped between the conveying rollers 7 and the pinch rollers 7*a*.

FIG. 5A shows a conveying state where the front end of the print medium S is about to reach the print area P. In a part of the conveying path, through which the print medium S is fed by the second feeding unit 6B toward the print area P, the plurality of conveying rollers 7, the plurality of pinch rollers 7*a*, and the inner guide 19 are provided such that the print medium S is conveyed to the platen 9 while being bent into an S-shape.

The rest of the conveying path is the same as that in the case of the A4 size print medium S shown in FIGS. 4B and 4C. FIG. 5B shows a state where the front end of the print medium S has passed through the print area P and the print medium S is being conveyed vertically upward. FIG. 5C shows a state where the front end of the print medium S has passed through the discharging roller 12 and the print medium S is being discharged into the discharging tray 13.

FIGS. 6A to 6D show a conveying path in the case of performing print operation (duplex printing) for the back side (second side) of an A4 size print medium S. In the case of duplex printing, print operation is first performed for the first side (front side) and then performed for the second side (back side). A conveying procedure during print operation for the first side is the same as that shown in FIGS. 4A to 4C and therefore description will be omitted. A conveying procedure subsequent to FIG. 4C will be described below.

Figures 6A, 6B, 6C, 6D:
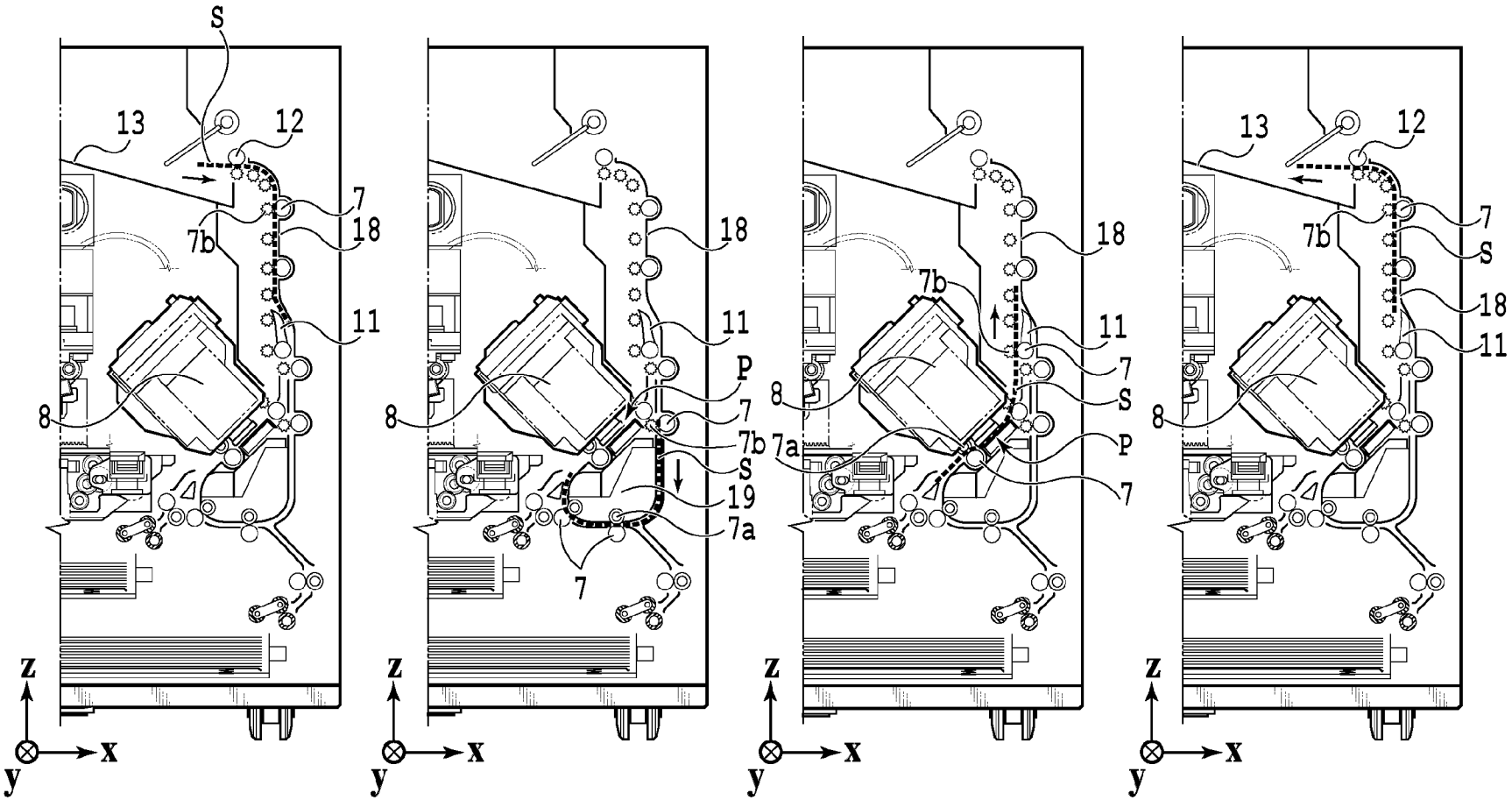
FIG. 6A, FIG. 6B, FIG. 6C, and FIG. 6D are views of views of a conveying path used in a case of performing a print operation on the back surface of a print medium.

After the print head 8 finishes print operation for the first side and the back end of the print medium S passes by the flapper 11, the print controller 202 turns the conveying rollers 7 backward to convey the print medium S into the printing apparatus 1. At this time, since the flapper 11 is controlled by an actuator (not shown) such that the tip of the flapper 11 is inclined to the left, the front end of the print medium S (corresponding to the back end during the print operation for the first side) passes on the right of the flapper 11 and is conveyed vertically downward. FIG. 6A shows a state where the front end of the print medium S (corresponding to the back end during the print operation for the first side) is passing on the right of the flapper 11.

Then, the print medium S is conveyed along the curved outer surface of the inner guide 19 and then conveyed again to the print area P between the print head 8 and the platen 9. At this time, the second side of the print medium S faces the ejection opening surface 8*a* of the print head 8. FIG. 6B shows a conveying state where the front end of the print medium S is about to reach the print area P for print operation for the second side.

The rest of the conveying path is the same as that in the case of the print operation for the first side shown in FIGS. 4B and 4C. FIG. 6C shows a state where the front end of the print medium S has passed through the print area P and the print medium S is being conveyed vertically upward. At this time, the flapper 11 is controlled by the actuator (not shown) such that the tip of the flapper 11 is inclined to the right. FIG. 6D shows a state where the front end of the print medium S has passed through the discharging roller 12 and the print medium S is being discharged into the discharging tray 13.

Next, maintenance operation for the print head 8 will be described. As described with reference to FIG. 1, the maintenance unit 16 of the present embodiment comprises the cap unit 10 and the wiping unit 17 and activates them at predetermined timings to perform maintenance operation.

Figure 7:
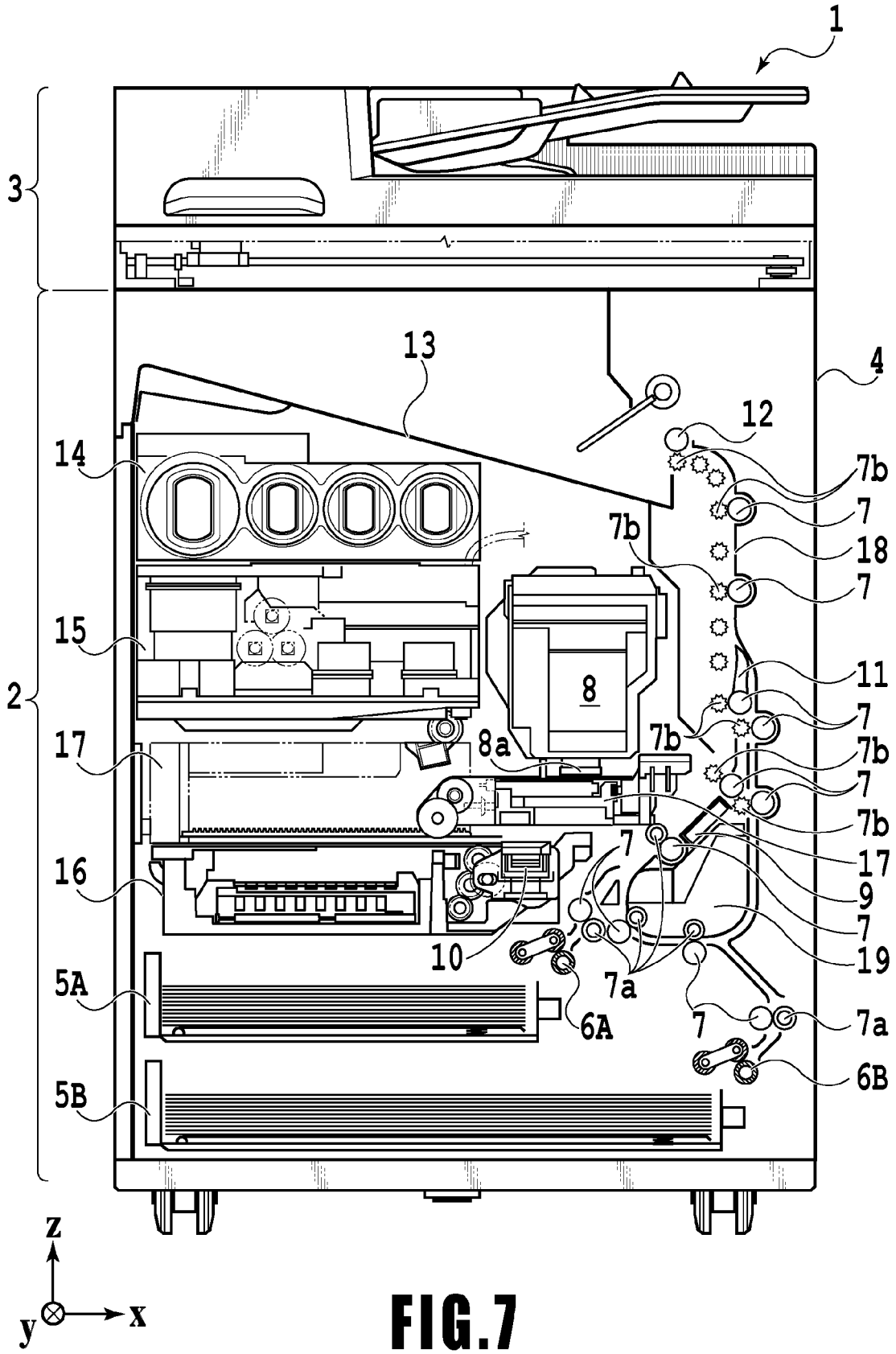
FIG. 7 is a view of the printing apparatus in a maintenance state.

FIG. 7 is a diagram showing the printing apparatus 1 in a maintenance state. In the case of moving the print head 8 from the standby position shown in FIG. 1 to a maintenance position shown in FIG. 7, the print controller 202 moves the print head 8 vertically upward and moves the cap unit 10 vertically downward. The print controller 202 then moves the wiping unit 17 from the evacuation position to the right in FIG. 7. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 7, the print controller 202 moves the print head 8 vertically upward while turning it 45°. The print controller 202 then moves the wiping unit 17 from the evacuation position to the right. Following that, the print controller 202 moves the print head 8 vertically downward to the maintenance position where maintenance operation can be performed.

Figure 8:
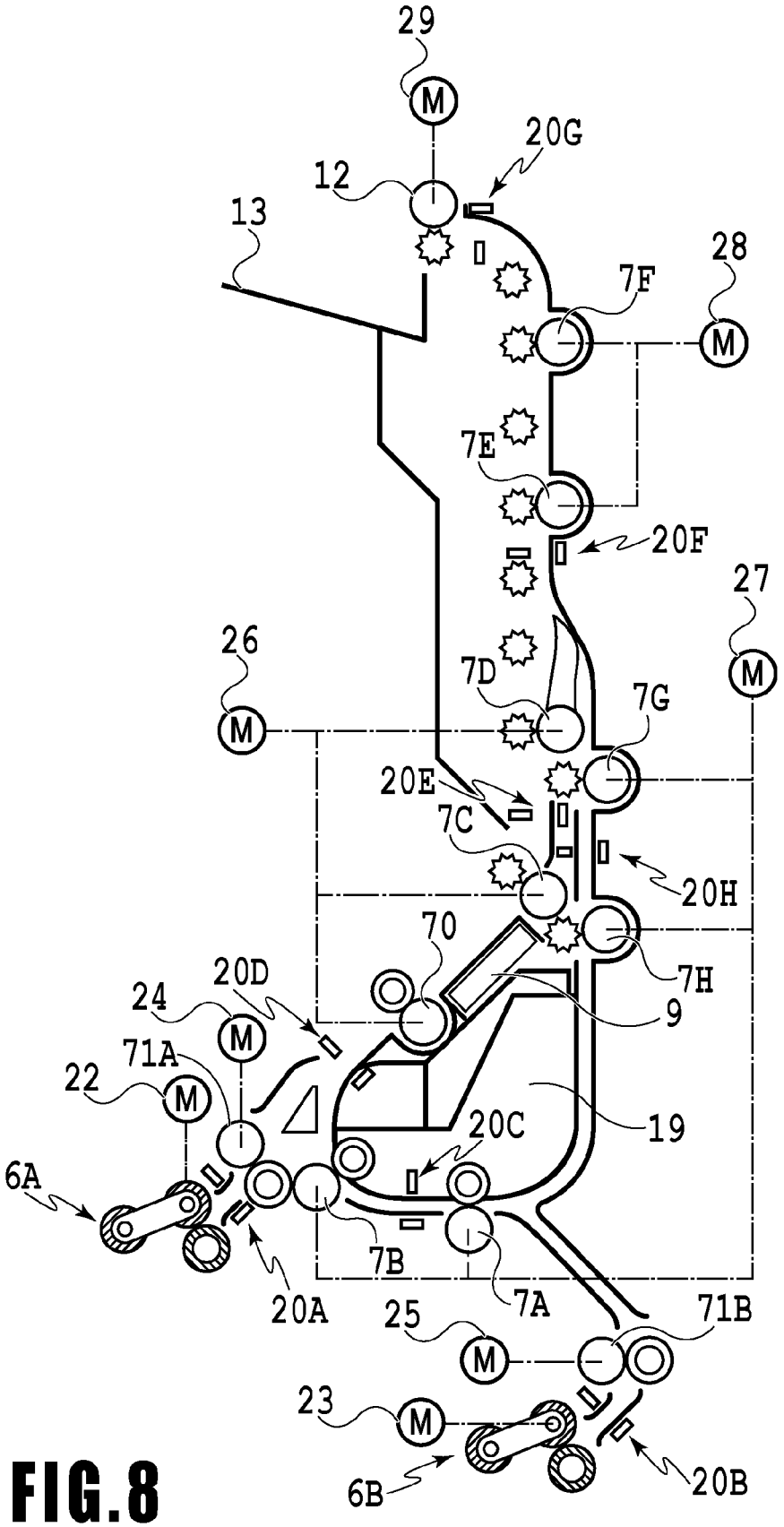
FIG. 8 is a diagram illustrating the relationship between drive rollers and motors.

FIG. 8 is a diagram illustrating the relationships between multiple motors and drive rollers in the printing apparatus 1. A first feeding motor 22 drives the first feeding unit 6A for feeding printing media S from the first cassette 5A. A second feeding motor 23 drives the second feeding unit 6B for feeding printing media S from the second cassette 5B. A first conveying motor 24 drives a first intermediate roller 71A which first conveys a printing medium S fed by the first feeding unit 6A. A second conveying motor 25 drives a second intermediate roller 71B which first conveys a printing medium S fed by the second feeding unit 6B.

A main conveying motor 26 drives a main conveying roller 70 which is disposed upstream of the platen 9 and mainly conveys the printing medium S being printed. The main conveying motor 26 also drives two conveying rollers 7 that are disposed downstream of the platen 9 and conveys the printing medium S conveyed by the main conveying roller 70, further downstream.

A third conveying motor 27 drives two conveying rollers 7 that convey downward the printing medium S the first side of which has been printed. The third the conveying motor 27 also drives two conveying rollers 7 disposed along the inner guide 19. These two conveying rollers 7 convey, toward the print head 8, a printing medium S fed from the second cassette 5B and conveyed by the second intermediate roller 71B or a printing medium S the first side of which has been printed and the front and back sides have been reversed.

A fourth conveying motor 28 drives two conveying rollers 7 that convey upward or downward a printing medium S that has been printed. A discharging motor 29 drives a discharging roller 12 for discharging a printing medium S that has been printed, to the discharging tray 13. As described above, the two feeding motors 22 and 23, the five conveying motors 24 to 28, and the discharging motor 29 each are associated with one or more drive rollers.

In addition, at eight positions along the conveying path are disposed detection members 20 for detecting the printing medium S. Each detection member 20 includes a sensor and mirror disposed on opposite sides of the conveying path. The sensor having a light emitting unit and a light receiving unit is disposed on one side of the conveying path, and the mirror is disposed on the other side of the conveying path, at a position facing the sensor. Each detection member 20 checks whether the light receiving unit has detected light emitted from the light emitting unit of the sensor and then reflected by the mirror to judge if a printing medium S is present, in other words, if the leading edge or the trailing edge has passed.

The conveyance control unit 207 drives the feeding motors 22 and 23, the conveying motors 24 to 28, and the discharging motor 29 separately based on detection results of the multiple detection members 20 and the output values of encoders for detecting the amount of rotation of the drive rollers, and thus controls the conveyance operation as the entire apparatus.

Figure 9B:
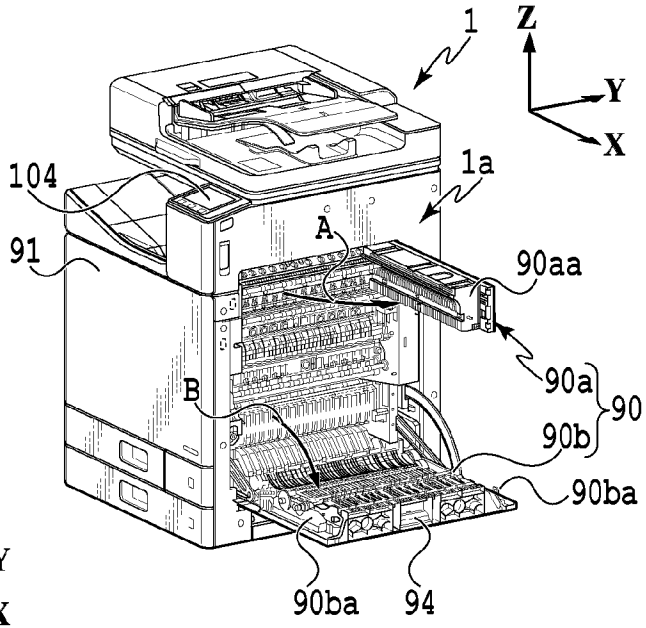
FIGS. 9A, 9B, and 9C are diagrams illustrating the states where a cover is closed and where the cover is opened.

Next, description will be provided for the cover that allows the user to access the conveying path. FIG. 9A is a diagram illustrating the state where the cover 90 is closed; FIG. 9B, the state where the cover 90 is sufficiently open; and FIG. 9C, the state where the second cover 90*b* is opened at a predetermined degree. FIG. 10 is a diagram illustrating the positional relationship between the cover 90 and the conveying path.

The cover 90 (cover unit) is disposed on the side surface 1*a* of the printing apparatus 1. The cover 90 includes a first cover 90*a* and a second cover 90*b*. Each of the first cover 90*a* and second cover 90*b* (cover members) is rotatably provided to the printing apparatus 1. Rotation of the first cover 90*a* and the second cover 90*b* changes the state of the conveying path between the state where the conveying path is exposed to the outside of the apparatus (hereinafter simply referred to as "the outside" as appropriate) and the state where the conveying path is shielded from the outside. On the inner surface of each of the first cover 90*a* and the second cover 90*b* is formed the outer conveyance surface of the conveying path. With this configuration, in the state where the first cover 90*a* and the second cover 90*b* are closed, the inner surfaces of the first cover 90*a* and the second cover 90*b* face the structures such as the spur 7*b* and the inner guide 19, forming part of the conveying path (see FIG. 10).

The first cover 90*a* (the other cover member) is disposed above the second cover 90*b*. The first cover 90*a* is rotatable about an axis extending in the vertical direction (in the z-direction). When the first cover 90*a* is closed, the first cover 90*a* is urged by an urging member 93 for the first cover 90*a* (see FIGS. 11A and 11B) in the arrow A direction. The urging member 93 is, for example, an elastic member such as a spring or a rubber. The first cover 90*a* is adapted to be kept closed by the locking part 92. Thus, the first cover 90*a* remains closed when it is locked by the locking part 92. In this state, the area of the conveying path, the conveyance surface of which is formed with the inner surface of the first cover 90*a*, is shielded from the outside. On the other hand, upon unlocking by the locking part 92 the first cover 90*a* is rotated in the arrow A direction by the urging force of the urging member 93 and opened. In this state, the area of the conveying path, the conveyance surface of which is formed with the inner surface of the first cover 90*a*, is exposed to the outside. The urging member 93 configured to urge the first cover 90*a* has an urging force strong enough to move the first cover 90*a* in the opening direction when the first cover 90*a* is closed.

The second cover 90*b* (one cover member) is disposed below and adjoining the first cover 90*a*. The second cover 90*b* is rotatable about an axis extending in the horizontal direction (in the y-direction) intersecting (orthogonal to) the vertical direction. When the second cover 90*b* is closed, the second cover 90*b* is urged by the urging member 93 for the second cover 90*b* in the arrow B direction. The second cover 90*b* is adapted to be kept closed by the locking part 96. Thus, the second cover 90*b* remains closed when it is locked by the locking part 96. In this state, the area of the conveying path, the conveyance surface of which is formed with the inner surface of the second cover 90*b*, is shielded from the outside. On the other hand, upon unlocking by the locking part 96, the second cover 90*b* is rotated in the arrow B direction by the urging force of the urging member 93 and remains open at a predetermined degree (see FIG. 9C). In this state, the area of the conveying path, the conveyance surface of which is formed with the inner surface of the second cover 90*b*, is exposed to the outside. The urging member 93 configured to urge the second cover 90*b* has an urging force strong enough to move the second cover 90*b* in the opening direction when the second cover 90*b* is closed. Specifically, the predetermined degree may be, for example, a degree that allows the user to perceive that the cover 90 has opened (a first predetermined degree), or a degree that allows the user not only to perceive that the cover 90 has opened but also to perceive the opening direction (a second predetermined degree).

Figure 9C:
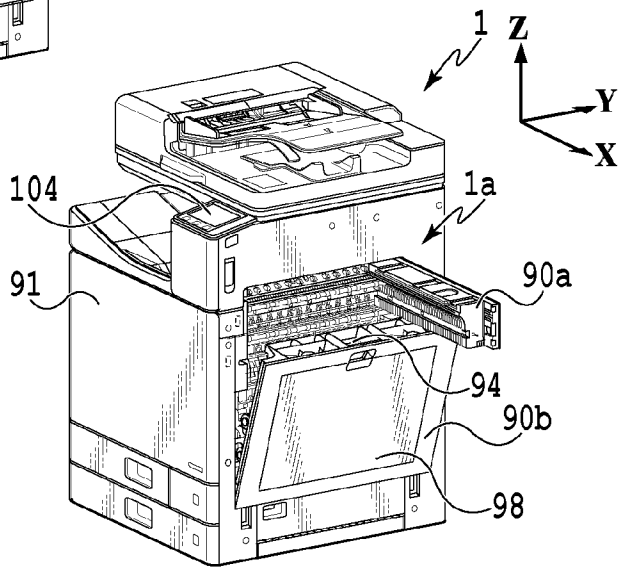
Figure 9A:
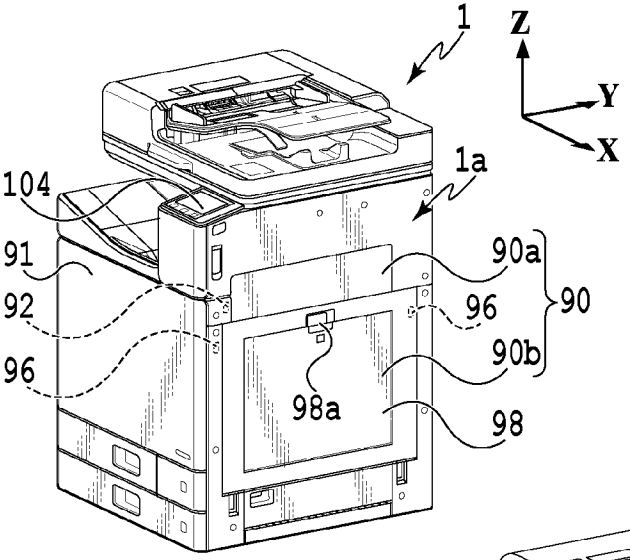
Figure 10:
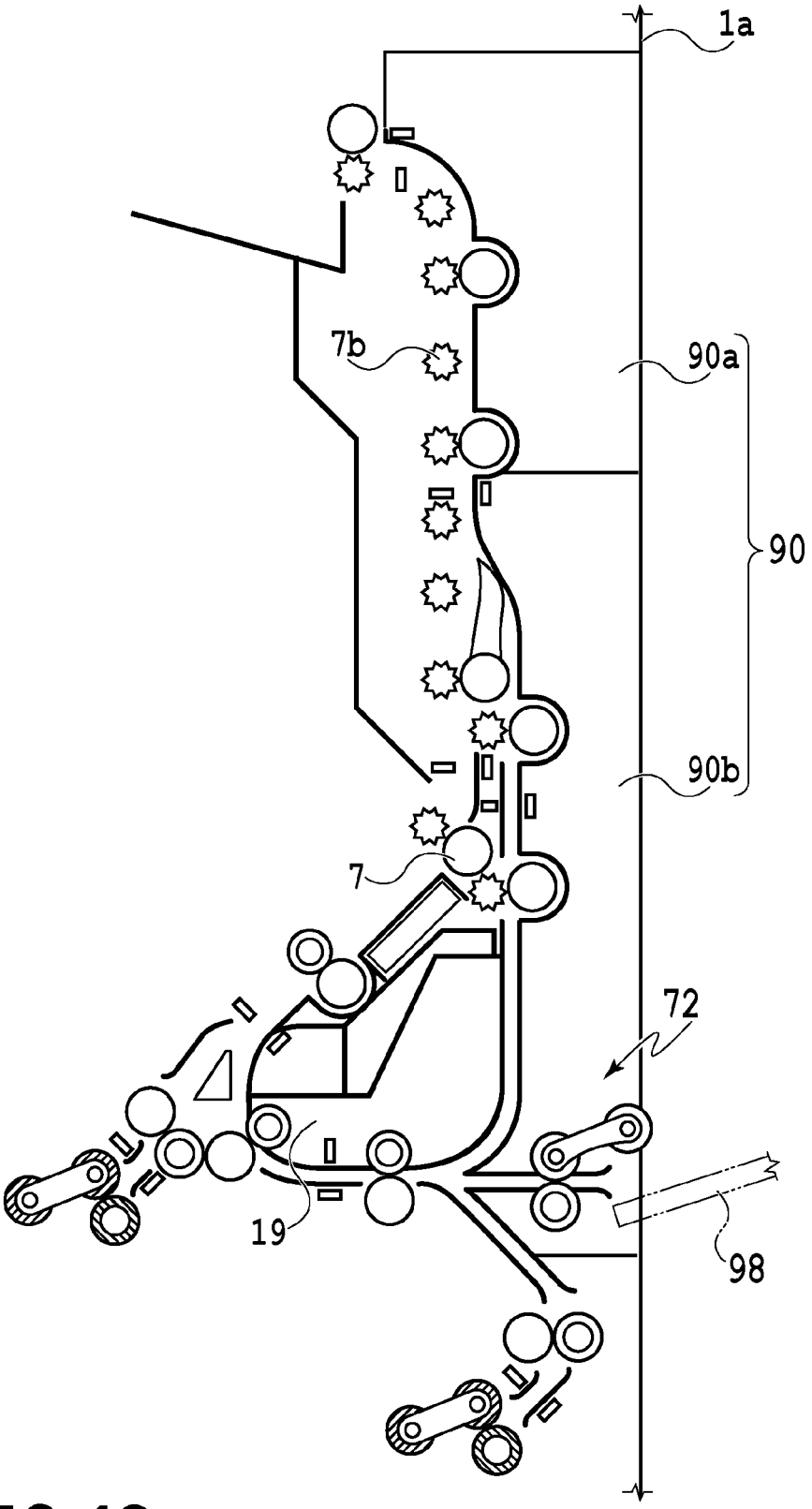
FIG. 10 is a diagram illustrating the positional relationship between first and second covers and the conveying path.

The second cover 90*b* has a handhold portion 94 which the user can hold, on the surface that faces the closed first cover 90*a* when the second cover 90*b* is closed (on the surface at the free end on the upper side) (see FIGS. 9B and 9C). Note that the handhold portion 94 is a structure for the user to easily open and close the second cover 90*b* by holding it. When the first cover 90*a* and the second cover 90*b* are closed (the cover 90 is closed), the handhold portion 94 is not exposed to the outside of the printing apparatus 1, so that the user cannot hold the handhold portion 94 (see FIG. 9A). In other words, when the cover 90 is closed, locking by the locking parts 92 and 96 prevents the user not only from opening the first cover 90*a* and the second cover 90*b*, but also even from holding the handhold portion 94. After the locking part 96 unlocks the second cover 90*b* and the second cover 90*b* opens by the predetermined degree from the state where the second cover 90*b* is closed, the user uses the handhold portion 94, which is now exposed to the outside, to further rotate the second cover 90*b* until the second cover 90*b* is put in a substantially horizontal state.

The second cover 90*b* is provided with a manual feed tray 98 such that the manual feed tray 98 can open and close on the second cover 90*b*. This manual feed tray 98 is rotatable about an axis extending horizontally (in the y-direction). The manual feed tray 98 is opened and closed by the user holding a handhold portion 98*a* exposed to the outside. In addition, the second cover 90*b* has an opening (not illustrated), through which the leading edge of the printing medium S placed on the opened manual feed tray 98 is inserted until it reaches a feeding roller 72 (see FIG. 10).

Figure 11A:
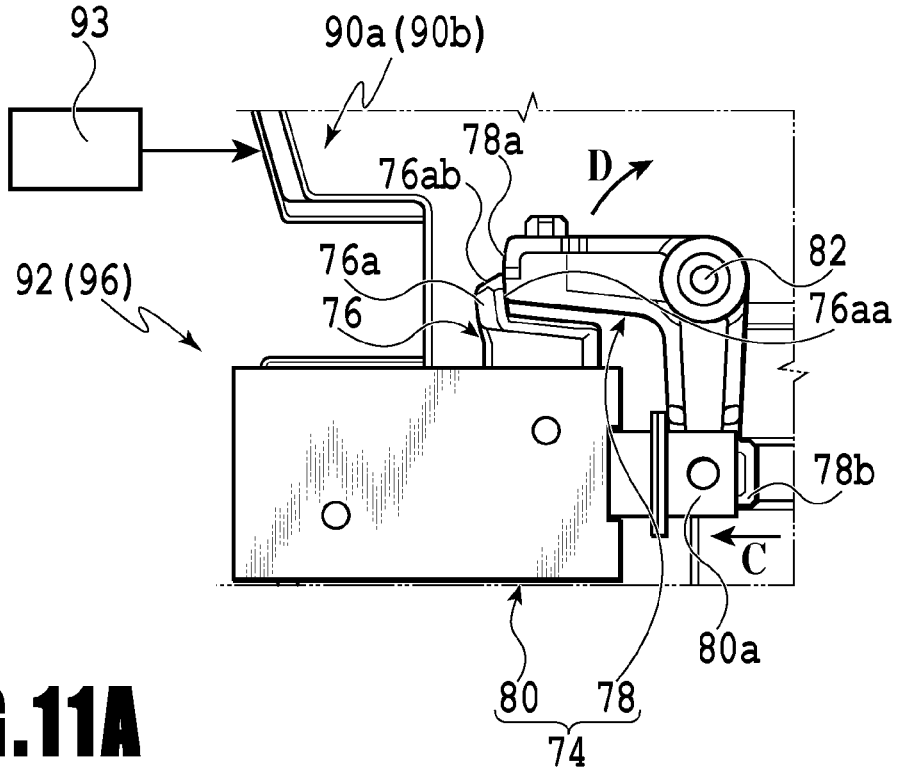
FIGS. 11A and 11B are diagrams illustrating operations of a locking part when it locks and unlocks.
Figure 11B:
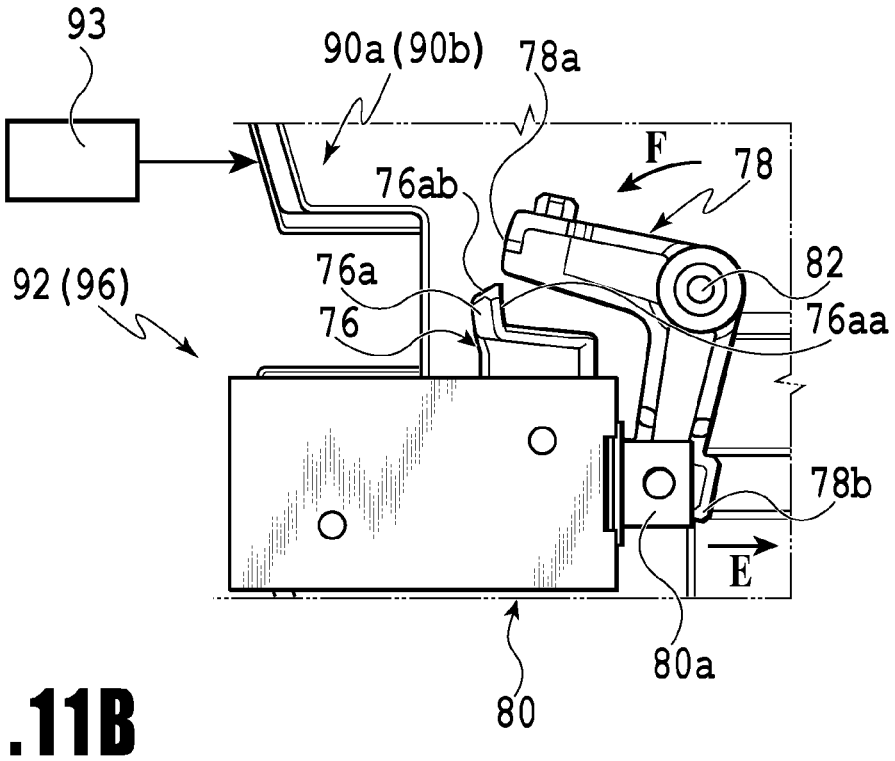

Next, the locking parts 92 and 96 will be described. Note that the locking part 92 for keeping the first cover 90*a* closed and the locking part 96 for keeping the second cover 90*b* closed have basically the same structure. Thus, in the following, description will be provided for the locking part 92, and as for the locking part 96, differences from the locking part 92 will be described. FIGS. 11A and 11B are schematic configuration diagrams of the locking part 92.

The locking part 92 (locking unit) includes a locking member 74 disposed on the printing apparatus 1 side (the casing 4) and an engaging member 76 that is disposed on the first cover 90*a* and can be engaged with the locking member 74. Specifically, in the locking part 92, the engaging member 76 is disposed at the free end 90*aa* of the first cover 90*a* (see FIG. 9B), and the locking member 74 is disposed at a position on the printing apparatus 1 side, facing the free end 90*aa* of the first cover 90*a* when the first cover 90*a* is closed.

In the locking part 96, an engaging member 76 is disposed on the free end side of each side portion 90*ba* (see FIG. 9B) of the second cover 90*b*, and a locking member 74 is disposed at a position on the printing apparatus 1 side, facing each side portion 90*ba* of the second cover 90*b* when the second cover 90*b* is closed. Note that although the locking part 96 works with the two side portions 90*ba* of the second cover 90*b*, the locking part 96 may work with only one of the side portions 90*ba*.

The locking member 74 includes a rotatable rotating part 78 formed in a substantially L shape and a driving part 80 for rotating the rotating part 78. The rotating part 78 is rotatable about a support shaft 82 which is located at the curved portion of the L shape. The rotating part 78 has one end 78*a* which can be engaged with the engaging member 76 and the other end 78*b* connected with a plunger 80*a* (to be described later) of the driving part 80.

The driving part 80 is a solenoid capable of moving the plunger 80*a* when the driving part 80 is energized. The rotating part 78 rotates in the arrow D direction, when the driving part 80 is energized and the plunger 80*a* moves in the arrow C direction. When the energization of the driving part 80 is stopped, an urging force such as a return spring (not illustrated) moves the plunger 80*a* in the arrow E direction. When the plunger 80*a* moves in the arrow E direction, the rotating part 78 rotates in the arrow F direction. The driving part 80 is energized for a predetermined time by the locking control unit 213 to move the plunger 80*a* in the arrow C direction. Thus, when the predetermined time passes, the plunger 80*a* is moved in the arrow E direction by the return spring, and the rotating part 78 rotates in the arrow F direction and returns to the initial position (the position illustrated in FIG. 11A).

The engaging member 76 has a protrusion 76*a* configured to be engaged with the one end 78*a* of the rotating part 78. The protrusion 76*a* has an engagement surface 76*aa* configured to be engaged with the one end 78*a*. In addition, the protrusion 76*a* has a slope 76*ab* which can rotate the rotating part 78 in the arrow D direction from its initial position by means of the movement of the first cover 90*a* from the state where it is opened to the state where it is closed.

Thus, in order to lock the first cover 90*a* with the locking part 92, first, the user rotates the first cover 90*a* from the open state to the closed state against the urging force of the urging member 93. During this operation, the one end 78*a* of the rotating part 78 at its initial position comes into contact with the slope 76*ab* of the protrusion 76*a*. As the first cover 90*a* rotates further, the slope 76*ab* rotates the rotating part 78 in the arrow D direction against the urging force of the return spring of the driving part 80. Then, as the first cover 90*a* rotates further, the one end 78*a* goes over the slope 76*ab*, the urging force of the return spring rotates the rotating part 78 in the arrow F direction, and the engagement surface 76*aa* comes into engagement with the one end 78*a*. Then, the locking part 92 keeps the first cover 90*a* closed. Note that while the locking part 92 is keeping the first cover 90*a* closed, the first cover 90*a* is kept urged by the urging member 93 (urging unit).

To unlock (release the lock) the first cover 90*a* from the locking part 92, the locking control unit 213 energizes the driving part 80 to rotate the rotating part 78 in the arrow D direction by the plunger 80*a*. This disengages the engagement surface 76*aa* from the one end 78*a*, and the urging force of the urging member 93 opens the first cover 90*a* (see FIG. 11B).

Note that these locking and unlocking structures of the locking part 92 are not limited to the structures described above, but any known technique can be used for them. In addition, the locking part 92 and the locking part 96 have the same structure in this embodiment, but they may be locking mechanisms with different structures.

As described earlier, the printing apparatus 1 has the detection unit 212, which detects abnormal conveyance of the printing medium S during print operation. Note that in this specification, the abnormal conveyance refer to the states where the printing medium S to be conveyed is not conveyed normally, such as a jam in which the printing medium S is jammed in the conveying path and a slip in which a conveying roller slips on the printing medium S, for example. The printing apparatus 1 has the operating panel 104 at an upper portion of the front side, and the user checks information displayed on the operating panel 104 and operates operating elements on the display. In other words, the operating panel 104 in this embodiment is a touch panel. Note that the operating panel 104 is not limited to a touch panel, but the operating panel 104 may have multiple operating elements or may have a touch panel and multiple operating elements together.

Figure 12:
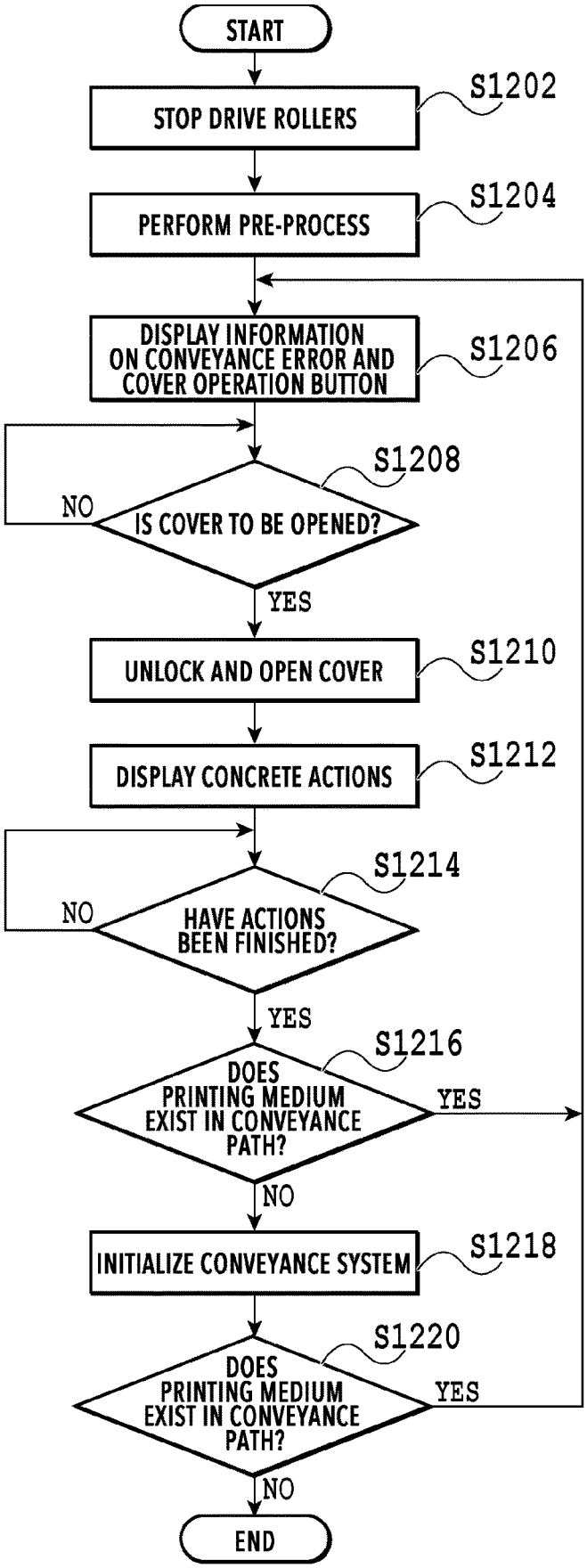
FIG. 12 is a flowchart illustrating detailed process contents of a resolving process.
Figure 13A:
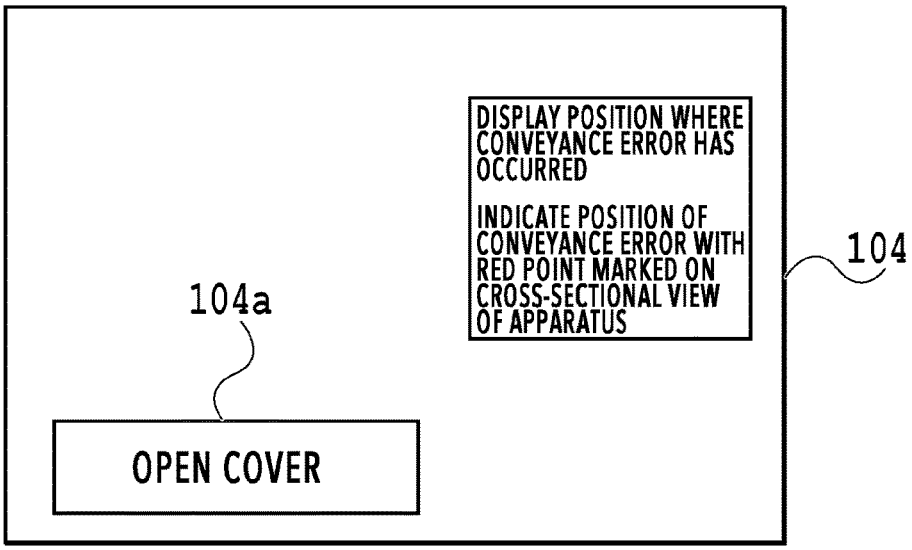
FIGS. 13A and 13B are diagrams illustrating an example of contents displayed on an operating panel.
Figure 13B:
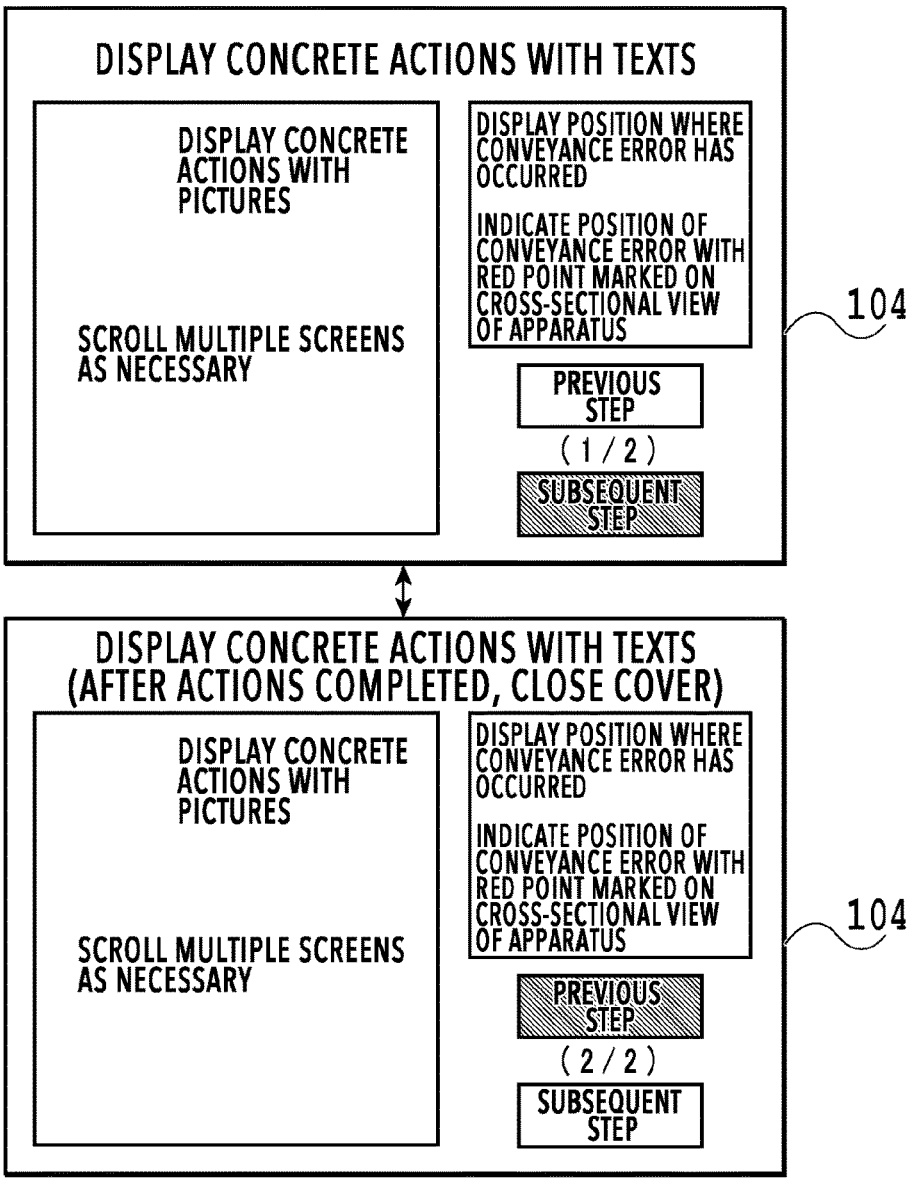

With the above configuration, when the detection unit 212 detects an abnormal conveyance, such as a jam, during print operation, a resolving process starts for resolving the abnormal conveyance. Note that the resolving process is executed by the print controller 202 according to a program stored in the ROM 203, using the RAM 204 as a work area. Here, the resolving process will be described in detail with reference to FIGS. 12, 13A, and 13B. FIG. 12 is a flowchart illustrating detailed process contents of the resolving process. FIGS. 13A and 13B are explanatory diagrams illustrating contents displayed on the operating panel 104 during the resolving process.

When this resolving process starts, driving of the drive rollers stops (S1202). Specifically, at S1202, the print controller 202 detects the position of the printing medium S on which an abnormal conveyance has occurred based on the detection result of the detection unit 212, and the conveyance control unit 207 stops driving the drive rollers positioned upstream of the detected position. At this moment, if a print operation is being performed, the print operation of the print head 8 is stopped. Note that the drive rollers include, for example, the feeding motors 22 and 23, the conveying motors 24, 25, 26, 27, and 28 and the discharging motor 29.

Next, pre-processes are performed (S1204). Specifically, at S1204, the head carriage control unit 208 moves the print head 8 from the print position to the standby position, and the maintenance control unit 210 caps the ejection opening surface 8*a* with the cap unit 10. In addition, printing media S positioned downstream of the printing medium S on which the abnormal conveyance has occurred are conveyed by the conveying rollers 7. Note that S1204 may be executed in parallel with S1202.

After that, information on the abnormal conveyance and an operation button for the cover 90 are displayed on the operating panel 104 (S1206). Specifically, at S1206, information indicating that an abnormal conveyance has occurred is, first, outputted to the main controller 101 via the controller I/F 201. After that, the main controller 101, for example, displays, on the operating panel 104, a notification indicating that an abnormal conveyance has occurred, and also the position where the abnormal conveyance has occurred as illustrated in FIG. 13A as information of the abnormal conveyance. The main controller 101 also displays a button 104*a* (operating element) for opening the cover 90 on the operating panel 104 as an operation button for the cover 90. Note that although in FIG. 13A, there are texts in the display area where the position of the abnormal conveyance is to be displayed, in a real setting an image of the printing apparatus 1 or a diagram schematically illustrating the printing apparatus 1 is used to clearly show the position where the abnormal conveyance has occurred. In this embodiment, the main controller 101 functions as a control unit that performs control to enable the operation on the operating panel 104 for causing the locking parts 92 and 96 to unlock.

Then, the main controller 101 judges whether to open the cover 90 (S1208). Specifically, at S1208, the main controller 101 judges whether the button 104*a* displayed on the operating panel 104 has been selected. If it is judged at S1208 that the button 104*a* has not been selected, in other words, the selection for opening the cover 90 has not been made, the process returns to S1208 again. In other words, in this embodiment, the process at S1208 is repeated until the button 104*a* is selected. If it is judged at S1208 that the button 104*a* has been selected, in other words, it is judged that the cover 90 is to be opened, the locking parts 92 and 96 unlock and open the cover 90 (S1210).

When the button 104*a* is selected, the information that the button 104*a* has been selected is outputted to the print controller 202. Thus, the print controller 202 controls the locking control unit 213 at S1210 to energize the driving parts 80 of the locking parts 92 and 96 and thus causes the locking part 92 and the locking part 96 to unlock the first cover 90*a* and the second cover 90*b*, respectively.

With this operation, the first cover 90*a* is rotated in the arrow A direction by the urging force of the urging member 93, and the second cover 90*b* is rotated in the arrow B direction by the urging force of the urging member 93. As a result, the cover 90 protrudes from the side surface 1*a* of the printing apparatus 1 (see FIG. 9C). This allows the user to easily perceive that the cover 90 has been unlocked and is openable. In addition, depending on the degrees at which the first cover 90*a* and the second cover 90*b* are opened by the urging members 93, the user can perceive the directions in which the first cover 90*a* and the second cover 90*b* open, and this makes it easy for the user to open the cover 90.

Note that the locking parts 92 and 96 may unlock at the same time, or may unlock one after the other. When the user selects the button 104*a*, for example, the button 104*a* is deleted from the operating panel 104.

Next, the concrete actions that the user should perform is displayed on the operating panel 104 (S1212). Specifically, at S1212, the concrete actions are displayed using diagrams, images, and texts as illustrated in FIG. 13B. Note that the contents displayed in this manner can be scrolled as necessary in the display area. In this case, buttons such as a "PREVIOUS STEP" button and a "SUBSEQUENT STEP" button are displayed. When the user selects these buttons, the contents displayed in the display area are scrolled to the previous screen or the subsequent screen. Note that although in FIG. 13B, there are texts in the display area where concrete actions are to be displayed, in a real setting an image of the printing apparatus 1 or a diagram schematically illustrating the printing apparatus 1 is displayed together with texts. Note that operation diagrams may be combined and displayed without displaying texts. This S1212 may be executed before S1210 or may be executed in parallel with S1210.

Next, it is judged whether the actions by the user to resolve the abnormal conveyance has been finished (S1214). Note that the printing apparatus 1 has not only the cover 90 but also, for example, a front cover 91 which is opened to replace the print head 8 or the ink tanks, and all these covers are provided with detection units (not illustrated) for detecting opening and closing of the covers. In addition, for example, the inner guide 19 which is part of the conveying path can be moved, for example, to remove a printing medium S on which an abnormal conveyance has occurred, and all these guides and the like are provided with detection units (not illustrated) for detecting whether they are positioned at their specified positions. Thus, at S1214, the print controller 202 judges based on detection results by these detection units whether all the covers are closed and all the guide are positioned at their specified positions.

If it is judged at S1214 that the actions by the user have not been finished, in other words, that all the covers are not closed, or all the guides are not positioned at their specified positions, the process at S1214 is executed again. If it is judged at S1214 that the actions by the user have been finished, in other words, that all the covers are closed, and all the guides are positioned at their specified positions, it is judged whether a printing medium S exists in the conveying path (S1216). Specifically, at S1216, the print controller 202 judges using detection members 20 whether a printing medium S exists in the conveying path.

If it is judged at S1216 that a printing medium S exists, it is judged that a jam has occurred. Then, the process returns to S1206, and the subsequent processes are executed. On the other hand, if it is judged at S1216 that a printing medium S does not exist, the conveyance control unit 207 initializes the conveyance system (S1218) and then judges again whether a printing medium S exists in the conveying path (S1220). Specifically, when an abnormal conveyance occurred, the drive motors and the like have been forcibly stopped. Thus, at S1218, the conveyance system is initialized; for example, the number of slits counted on each of the encoders associated with the drive rollers is initialized. In addition, at S1220, it is judged whether a printing medium S exists in the conveying path after the initialization of the conveyance system. Note that concrete process contents at S1220 are the same as those of S1216.

If it is judged at S1220 that a printing medium S exists, the process proceeds to S1206, and the subsequent processes are executed. On the other hand, if it is judged at S1220 that a printing medium S does not exist, this resolving process ends.

As has been described above, the printing apparatus 1 has the first cover 90*a* and the second cover 90*b* as the cover 90 that allows the user to access the conveying path by opening it in the case of an abnormal conveyance or the like. The first cover 90*a* does not have a structure that the user holds, and thus the first cover 90*a* remains closed by being locked by the locking part 92. When unlocked, the first cover 90*a* is rotated by the urging force of the urging member 93 and kept open. The second cover 90*b* has the handhold portion 94 which is not exposed to the outside when the second cover 90*b* is closed along with the first cover 90*a* and is exposed to the outside when the second cover 90*b* is opened. The second cover 90*b* remains closed by being locked by the locking part 96. When unlocked, the second cover 90*b* is rotated by the urging force of the urging member 93 by a predetermined degree and kept open. In addition, in the printing apparatus 1, when an abnormal conveyance is detected, the button 104*a* for opening the cover 90 is displayed on the operating panel 104. When the user selects the button 104*a*, the locking parts 92 and 96 unlock, and the cover 90 opens.

In the printing apparatus 1 with this configuration, when the locking parts 92 and 96 unlock the cover 90, the first cover 90*a* and the second cover 90*b* are rotated by the urging force of the urging members 93 and protrude from the side surface 1*a* of the printing apparatus 1. This allows the user to easily perceive that the cover 90 is unlocked and the first cover 90*a* and the second cover 90*b* are openable. Thus, unlike the technique disclosed in Japanese Patent Laid-Open No. 2010-149308 in which the cover is simply unlocked, the printing apparatus 1 allows the user to easily perceive the cover to be opened, preventing the user from erroneously trying to open the cover when it is locked.

In addition, the unlocked first cover 90*a* and second cover 90*b* rotate by the predetermined degree, which allows the user to know how to open (the opening directions of) the first cover 90*a* and the second cover 90*b*. This improves operability for the user, and thus, even if the user is not familiar with the work, the user can open the cover 90 without a difficulty.

Even when the user erroneously tries to open the cover 90 when it is locked, the user cannot hold the cover 90 with the user's hand, which makes it very difficult for the user to rotate the cover 90 by holding it. In the technique disclosed in Japanese Patent Laid-Open No. 2010-149308, a handhold portion provided on the cover is always exposed to the outside. Because of this structure, in the technique disclosed in Japanese Patent Laid-Open No. 2010-149308, when the user erroneously tries to open the cover when it is locked, the handhold portion, the locking mechanism, and the cover movement mechanism receive loads, which may break the cover. On the other hand, in the printing apparatus 1, the handhold portion 94 is not exposed to the outside, making it difficult to open the cover 90. This prevents the user from erroneously trying to open the cover 90. In other words, the handhold portion 94 and the locking parts 92 and 96 will not receive heavy loads owing to an erroneous operation by the user. Thus, the cover is less likely to break than in the technique in Japanese Patent Laid-Open No. 2010-149308.

Note that the embodiment described above may be modified according to (1) to (7) described below.

(1) Printing apparatuses to which the present invention is applicable are not limited only to inkjet printing apparatuses, but the present invention is applicable to those for performing printing on printing media S in various ways. In addition, printing apparatuses to which the present invention is applicable are not limited only to inkjet printing apparatuses of what is called the full line type, as in the above embodiment, but the present invention is applicable to, for example, inkjet printing apparatuses of the serial scanning type.

(2) In the above embodiment, as for the process involving opening the cover 90, the description has been provided as an example for the case where an abnormal conveyance has occurred. However, the process involving opening the cover 90 may be executed at predetermined timings at which various operations are performed by opening the cover 90. Specifically, for example, in the case of cleaning the inside of the conveying path, first, the print head 8 is moved to the standby position and capped with the cap unit 10, as a pre-process, at a timing, for example, at which the number of printing operations reaches a predetermined number. Then, the button 104*a* is displayed on the operating panel 104. When the button 104*a* is selected, the locking parts 92 and 96 unlock the cover 90, and a concrete cleaning procedure for the conveying path is displayed.

(3) Although in the above embodiment, the cover 90 includes two members (the first cover 90*a* and the second cover 90*b*), the present invention is not limited to this configuration. Specifically, the cover 90 may consist of one member or three or more members. In addition, although in the above embodiment, when the locking part 96 unlocks the second cover 90*b*, the second cover 90*b* rotates by the predetermined degree (see FIG. 9C), the present invention is not limited to this configuration. Specifically, when unlocked, the second cover 90*b* may rotate until it is fully open as illustrated in FIG. 9B.

In addition, although not specifically described in the above embodiment, the first cover 90*a*, when unlocked, may be rotated by the urging member 93 by the predetermined degree or the first cover 90*a* may be rotated until it is fully open as illustrated in FIG. 9B. Note that the state where the first cover 90*a* is fully open means, for example, the state where it has rotated and opened by 90 degrees from the closed state. Further, although in the above embodiment, the first cover 90*a* and the second cover 90*b* open and close by rotating, the present invention is not limited to this configuration. Specifically, the first cover 90*a* and the second cover 90*b* may slide to expose and shield the conveying path.

(4) Although in the above embodiment, the button 104*a* for opening the cover 90 is displayed on the operating panel 104, the present invention is not limited to this configuration. Specifically, a mechanical switch (button) for opening the cover 90 may be provided on the printing apparatus 1 at a position that allows the user to operate the switch. Note that this switch may always be operable or may be made operable at a predetermined timing, for example, at which the detection unit 212 detects an abnormal conveyance. In addition, in the above embodiment, when an abnormal conveyance has occurred, the button 104*a* is displayed on the operating panel 104, but the present invention is not limited to this configuration. Specifically, the button 104*a* may be displayed on the operating panel 104 all the time.

(5) In the above embodiment, when the detection unit 212 detects an abnormal conveyance on a printing medium S, the button 104*a* is displayed on the operating panel 104 after the print head 8 is protected with the cap unit 10 at the standby position. However, the present invention is not limited to this configuration. Specifically, the button 104*a* may be displayed on the operating panel 104 in parallel with the operation for protecting the print head 8 with the cap unit 10 at the standby position.

(6) Although in the above embodiment, the handhold portion 94 is provided at a position that is not exposed to the outside when the second cover 90*b* is closed, the present invention is not limited to this configuration. Specifically, the second cover 90*b* may have a mechanism for covering the handhold portion 94 in order for the handhold portion 94 not to be exposed to the outside when the second cover 90*b* is closed. In addition, the first cover 90*a* may have a handhold portion 94. Alternatively, the configuration may be such that the second cover 90*b* does not have the handhold portion 94. Further, the configuration may be such that the handhold portion 94 is exposed to the outside when the cover 90 is closed but the operating panel 104 indicates that the cover 90 cannot be opened.

(7) Although in the above embodiment, the first cover 90*a* and the second cover 90*b* are urged in their opening directions by the urging members 93 when they are closed, the present invention is not limited to this configuration. Specifically, each of the first cover 90*a* and the second cover 90*b* may always be urged in the opening direction by an urging member such as a torsion spring provided at the center axis. In addition, although in the above embodiment, the first cover 90*a* and the second cover 90*b* in their closed state are urged by the urging members 93 formed of elastic members, such as springs, the present invention is not limited to this configuration. Specifically, pressing parts may be provided for pressing the first cover 90*a* and the second cover 90*b*, and the first cover 90*a* and the second cover 90*b* may be urged in their opening directions by the pressing parts pressing the first cover 90*a* and the second cover 90*b* when the locking parts 92 and 96 unlock them. In this case, the pressing parts function as urging units. In addition, since the conveyance control unit 207 can find out the position where an abnormal conveyance has occurred in the conveying path, the configuration may be such that only the first cover 90*a* is opened, or conversely only the second cover 90*b* is opened, depending on the position of the abnormal conveyance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-021194 filed Feb. 8, 2018, which is hereby incorporated by reference herein in its entirety.

What is claimed is:

1. A printing apparatus comprising:

a conveying unit configured to convey a printing medium along a conveying path;

a print unit configured to apply print material on a printing medium being conveyed by the conveying unit;

a cover member that is capable of opening and closing by rotating such that (a) a part of the conveying path is exposed to an outside when the cover member is opened and (b) the cover member shields the part of the conveying path from the outside and is a part of an outside surface of the printing apparatus, when the cover member is closed, wherein the cover member includes a handhold portion that the user is able to hold with a hand of the user, wherein the handhold portion is not exposed to the outside when the cover member is closed, and wherein the handhold portion is exposed to the outside when the cover member is opened;

a locking unit configured to lock the cover member to keep the cover member closed; and an urging unit configured to urge the cover member in an opening direction of the cover member such that the cover member opens by a degree which is required to be moved further in the opening direction until full open of the cover member so as to protrude from the outside surface of the printing apparatus in a case where the locking unit releases the cover member, wherein when the cover member is closed, the handhold portion is covered with a further cover member which adjoins the cover member, and wherein the further cover member is capable of (a) opening to expose another part of the conveying path to the outside and (b) closing to shield the another part of the conveying path from the outside, by rotating in directions which are different from directions of rotation of the cover member.

2. The printing apparatus according to claim 1, wherein the degree includes a first predetermined degree that allows a user to perceive that the cover member has opened or a second predetermined degree that allows the user to perceive that the cover member has opened and to perceive the opening direction of the cover member.

3. The printing apparatus according to claim 1, wherein the cover member is closed against an urging force of the urging unit.

4. The printing apparatus according to claim 1, further comprising an operating unit through which the locking unit is caused to unlock the cover member.

5. The printing apparatus according to claim 4, further comprising a control unit configured to perform control to enable operation of the operating unit.

6. The printing apparatus according to claim 5, wherein the control unit enables operation of the operating unit at at least one of a timing when an abnormal conveyance on the printing medium occurs in the conveying path and a timing when the conveying path is to be cleaned.

7. The printing apparatus according to claim 5, wherein the operating unit is a touch panel, and wherein the control unit displays on the operating unit an operating element for causing the locking unit to unlock the cover member.

8. The printing apparatus according to claim 1, wherein the print unit is a print head provided with an ejection opening for ejecting ink.

9. The printing apparatus according to claim 1, further comprising a protecting unit configured to protect the print unit, wherein when the cover member is unlocked, the print unit is protected by the protecting unit.

10. The printing apparatus according to claim 1, wherein the locking unit includes (1) a locking member disposed at a casing of the printing apparatus and (2) an engaging member disposed on the cover member.

11. The printing apparatus according to claim 1, wherein the cover member is capable of opening and closing by rotating about an axis.

12. A conveyance apparatus comprising:

a conveying unit configured to convey a printing medium along a conveying path;

a cover member that is capable of opening and closing by rotating such that (a) a part of the conveying path is exposed to an outside when the cover member is opened and (b) the cover member shields the part of the conveying path from the outside and is a part of an outside surface of the conveyance apparatus, when the cover member is closed, wherein the cover member includes a handhold portion that the user is able to hold with a hand of the user, wherein the handhold portion is not exposed to the outside when the cover member is closed, and wherein the handhold portion is exposed to the outside when the cover member is opened;

a locking unit configured to lock the cover member to keep the cover member closed; and an urging unit configured to urge the cover member in an opening direction of the cover member such that the cover member opens by a degree which is required to be moved further in the opening direction until full open of the cover member so as to protrude from the outside surface of the conveyance apparatus in a case where the locking unit releases the cover member, wherein when the cover member is closed, the handhold portion is covered with a further cover member which adjoins the cover member, and wherein the further cover member is capable of (a) opening to expose another part of the conveying path to the outside and (b) closing to shield the another part of the conveying path from the outside, by rotating in directions which are different from directions of rotation of the cover member.

13. The conveyance apparatus according to claim 12, wherein the degree includes a first predetermined degree that allows a user to perceive that the cover member has opened or a second predetermined degree that allows the user to perceive that the cover member has opened and to perceive the opening direction of the cover member.

14. The conveyance apparatus according to claim 12, wherein the cover member is closed against an urging force of the urging unit.

15. The conveyance apparatus according to claim 12, further comprising an operating unit through which the locking unit is caused to unlock the cover member.

16. The conveyance apparatus according to claim 15, further comprising a control unit configured to perform control to enable operation of the operating unit.

17. The conveyance apparatus according to claim 16, wherein the control unit enables operation of the operating unit at at least one of a timing when an abnormal conveyance on the printing medium occurs in the conveying path and a timing when the conveying path is to be cleaned.

18. The conveyance apparatus according to claim 12, wherein the locking unit includes (1) a locking member disposed at a casing of the conveyance apparatus and (2) an engaging member disposed on the cover member.

19. The conveyance apparatus according to claim 12, wherein the cover member is capable of opening and closing by rotating about an axis.

20. A conveyance apparatus comprising:

a conveying unit configured to convey a printing medium along a conveying path;

a cover member that is capable of opening and closing by rotating such that (a) a part of the conveying path is exposed to an outside when the cover member is opened and (b) the cover member shields the part of the conveying path from the outside and is a part of an outside surface of the conveyance apparatus, when the cover member is closed, wherein the cover member includes a handhold portion that the user is able to hold with a hand of the user, wherein the handhold portion is not exposed to the outside when the cover member is closed, and wherein the handhold portion is exposed to the outside when the cover member is opened;

a locking unit configured to lock the cover member to keep the cover member closed; and an urging unit configured to urge the cover member in an opening direction of the cover member such that the cover member opens by a degree that is less than that which is required to be moved in the opening direction of the cover member until full open of the cover member so as to protrude from the outside surface of the conveyance apparatus in a case where the locking unit releases the cover member, the cover member being configured to be further openable thereafter in response to a user operation to full open of the cover member, wherein when the cover member is closed, the handhold portion is covered with a further cover member which adjoins the cover member, and wherein the further cover member is capable of (a) opening to expose another part of the conveying path to the outside and (b) closing to shield the another part of the conveying path from the outside, by rotating in directions which are different from directions of rotation of the cover member.

* * * * *